US007155756B1

(12) United States Patent
Helder

(10) Patent No.: US 7,155,756 B1
(45) Date of Patent: Jan. 2, 2007

(54) HOT TUB COVER LIFTER

(76) Inventor: Bruce A. Helder, 1336 Richwood Dr., SE., Grand Rapids, MI (US) 49508

( * ) Notice: Subject to any disclaimer, the term of this patent is extended or adjusted under 35 U.S.C. 154(b) by 275 days.

(21) Appl. No.: 10/711,350

(22) Filed: Sep. 13, 2004

Related U.S. Application Data

(60) Provisional application No. 60/481,365, filed on Sep. 12, 2003.

(51) Int. Cl.
*E04H 4/00* (2006.01)

(52) U.S. Cl. ..... 4/498

(58) Field of Classification Search ..... 4/498
See application file for complete search history.

(56) References Cited

U.S. PATENT DOCUMENTS

| | | | | |
|---|---|---|---|---|
| 6,032,305 | A * | 3/2000 | Tedrick | 4/498 |
| 6,158,063 | A * | 12/2000 | Tudor | 4/500 |
| 6,393,630 | B1 * | 5/2002 | Tedrick | 4/498 |
| 6,647,561 | B1 * | 11/2003 | Walton et al. | 4/502 |

* cited by examiner

*Primary Examiner*—Charles E. Phillips
(74) *Attorney, Agent, or Firm*—McGarry Bair PC

(57) ABSTRACT

This invention encompasses an automated mechanism to remove a heavy and bulky insulating cover from an above-floor hot tub (or spa), and to provide a storage location for the cover when the tub is in use. The cover lifter can be fully automatic or semi automatic, and can be operated either electrically, or by fluid or air under pressure.

3 Claims, 16 Drawing Sheets

HOT TUB COVER LIFTER

CROSS-REFERENCE TO RELATED APPLICATION

This application claims the benefit of U.S. provisional application Ser. No. 60/481,365, filed Sep. 12, 2003, which is incorporated herein in its entirety.

FIELD OF THE INVENTION

The invention relates generally to covers installed over hot tubs and in particular to a lifter for removing and replacing a hot tub cover.

DESCRIPTION OF THE RELATED ART

The purpose of a hot tub cover is twofold. Its primary function is to insulate the heated water inside the tub from the cooler air outside of the tub. Keeping the heat internal to the hot tub dramatically reduces the cost to operate the heating mechanism of the tub. By design, the thicker the cover is, the better it will perform its insulating task. However, a thicker cover also becomes very heavy and difficult to move and store when the tub is to be used.

The second function of the cover is to prevent small children from falling into the tub. The stronger the cover, the more protection it will provide. Either the weight will be too much for a child to lift, or the cover will be strong enough to support a child should the child step on the cover. However, the safer the cover, the heavier it is, and the more difficult it is to move and store when the tub is in use. The weight and size of the cover may be a deterrent to potential purchasers of hot tubs. For example, elderly people, or people with physical limitations, may be dissuaded from purchasing a hot tub because of the person's inability to handle the removal and replacement of the cover, even though the person may benefit from the relaxation and health benefits of a hot tub.

SUMMARY OF THE INVENTION

A lifting mechanism for removing and storing a hot tub cover comprises at least one power pedestal having a rotational actuator, a threaded shaft rotated by the actuator, a carriage bar having a threaded aperture adapted for threadable cooperation with the threaded shaft, and a fixed roller adapted for rotation about a horizontal axis, and at least one U-shaped lift arm attached to the hot tub cover and adapted for lifting the hot tub cover from the hot tub, wherein a free end of the lift arm is pivotably attached to the carriage bar and rests upon the fixed roller, and the carriage bar is adapted to translate vertically with rotation of the threaded shaft by the actuator, so that the vertical translation of the carriage bar will urge the pivotal movement of the lift arm about the fixed roller to selectively raise and lower the hot tub cover.

The hot tub cover can comprise a first cover portion connected by a hinge to a second cover portion. A secondary lift arm is pivotably connected to the first lift arm for selectively pivoting the second cover portion relative to the first cover portion. The lifting mechanism can further comprise an actuator, a drive shaft, and a gear assembly interconnecting the drive shaft and the pivot connection, wherein the actuator rotates the drive shaft, the drive shaft turns the gear assembly, and the gear assembly rotates the pivot arm to pivot the second cover portion relative to the first cover portion.

DESCRIPTION OF EMBODIMENTS OF THE INVENTION

Figure 1:
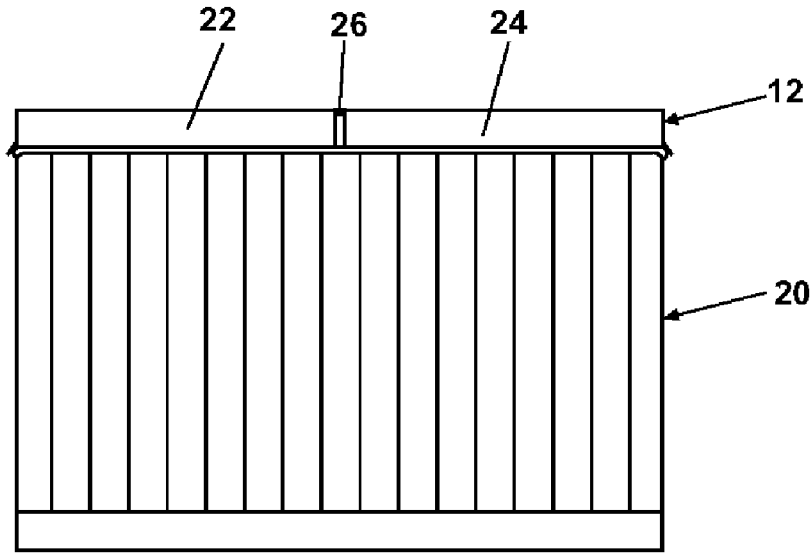
Fig. 1 (PRIOR ART)
FIG. 1 is a front elevational view of a prior art hot tub with a cover.

Referring now to the drawings and to FIG. 1 in particular, a conventional hot tub cover 12 for covering a hot tub 20 comprises two similar-sized pads 22, 24 that are joined at the center by a hinge 26. One of the pads 22, 24, can be folded over the other pad for ease in removal and storage of the cover 12 during use of the hot tub 20.

Referring now to FIGS. 2–12 in general, a first embodiment of a hot tub cover lift mechanism comprises a semi-automatic mechanism wherein the user manually flips one of the pads onto the other pad. Once the first pad is flipped over, an actuator assembly pivots a lift arm to lift the entire cover, remove it from the hot tub, and store it along the side of the hot tub, out of the way of the user. The second embodiment of the cover lift mechanism according to the invention has a fully automatic cover remover in which a first actuator flips the first pad onto the second pad, and the actuator assembly pivots the lift arm to lift the cover and store it along the side of the hot tub.

Figure 2:
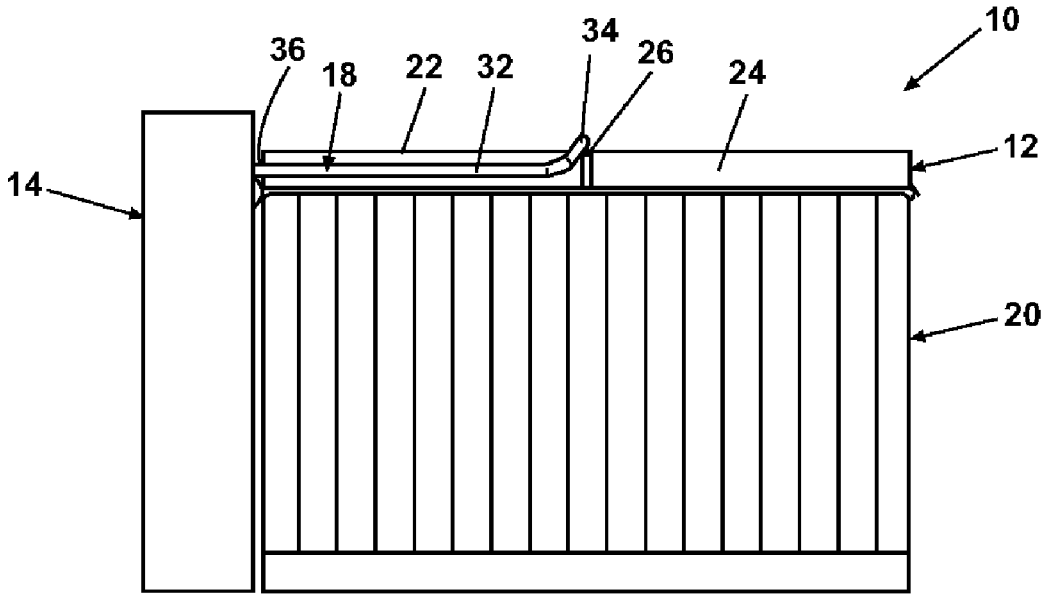
FIG. 2 is a side elevational view of a hot tub having a cover lift mechanism according to the invention.
Figure 3:
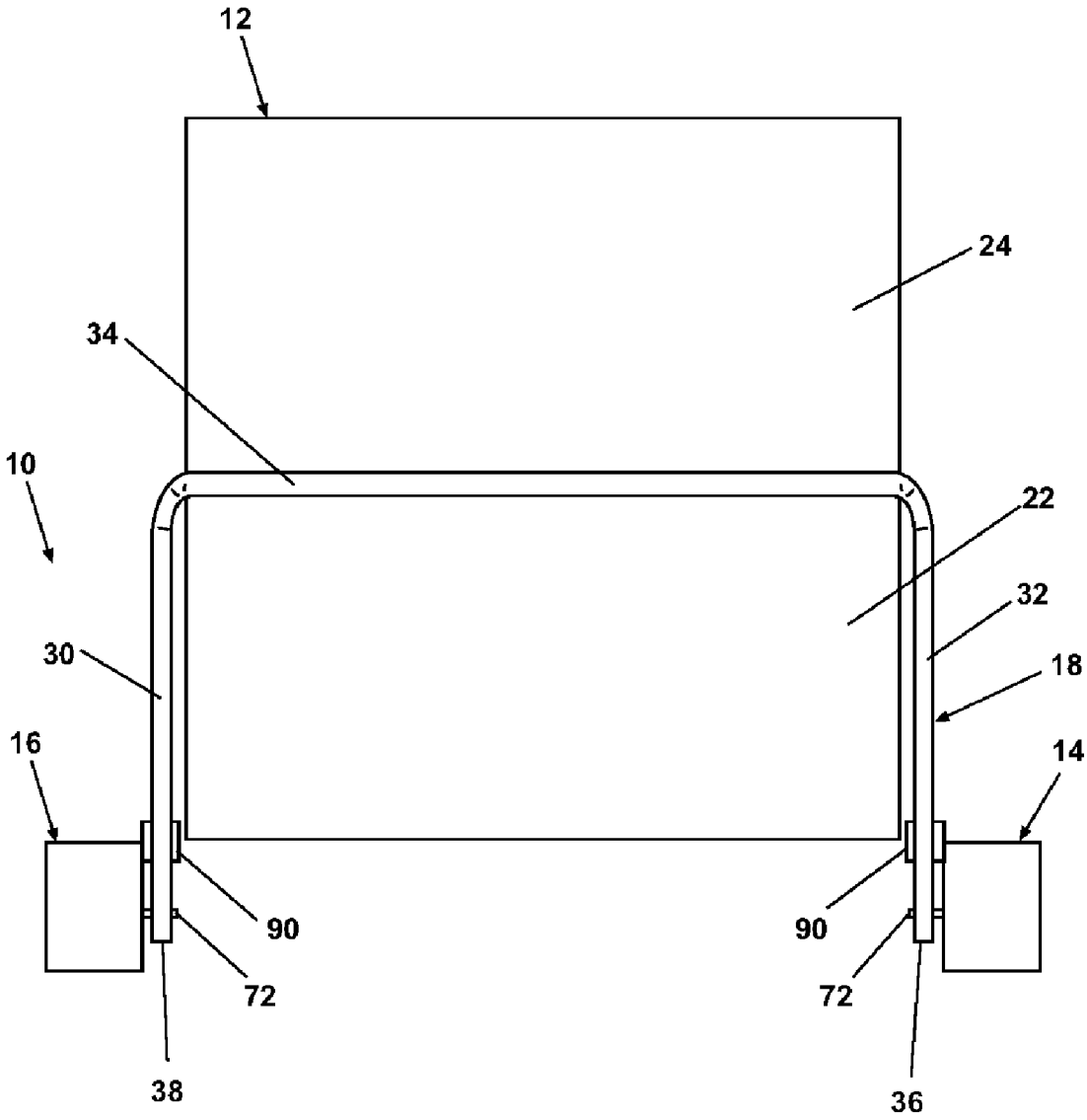
FIG. 3 is a top plan view of the cover lift mechanism illustrated in FIG. 2.

Referring to FIGS. 2–3, the cover lift mechanism for a hot tub cover 12 comprises a pair of power pedestals 14, 16, and a lift arm 18. The cover 12 is illustrated installed over a hot tub 20. The cover 12 is generally conventional in structure and configuration, and comprises two separate, generally identical rectilinear pads 22, 24 joined together along respective longitudinal, abutting edges with a hinge 26 adapted to enable the pad 24 to be folded over to rest on the pad 22.

In the embodiment shown in FIGS. 2–3, the cover remover consists of a generally U-shaped lift arm 18 comprising a pair of generally parallel, elongated arm segments 30, 32 joined at one end by a support member 34 extending orthogonally therebetween. The arm segments 30, 32 incline upwardly at their junction with the support member 34 so that the support member 34 lies above the plane defined by the arm segments 30, 32. An opposed pivot end 36, 38 of each arm segment 30, 32 is operably connected to a power pedestal 14, 16, as hereinafter described. The arm segments 30, 32 extend away from the power pedestals 14, 16 to lie along opposed, outer sides of the pad 22 so that the support member 34 extends laterally over the cover 12 across the hinge 26 at the center of the cover 12. Preferably, the arm 18 is not attached to the hot tub cover 12, and the support member 34 simply rests on top of the cover 12. Alternatively, the arm 18, particularly the support member 34, can be attached to the pad 22 through suitable connectors, such as straps, rivets, or the like. In such case, it is preferable that the attachment of the cover 12 to the arm 18 secure the pad 22 to the arm 18 but enable the pad 24 to be folded onto the pad 22 along the hinge 26.

Figure 4:
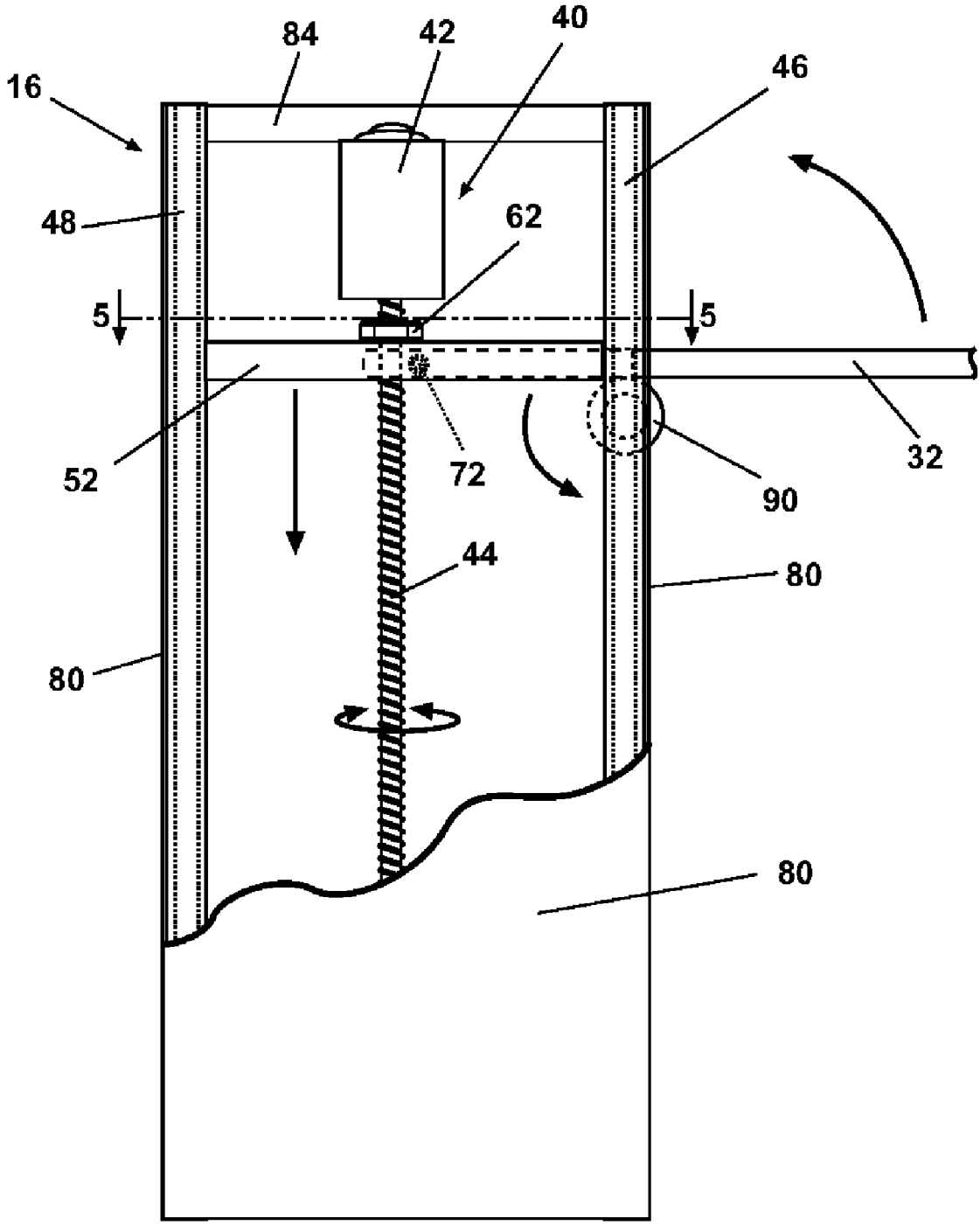
FIG. 4 is a side elevational view of a power pedestal shown in FIG. 2, with portions removed for clarity.
Figure 5:
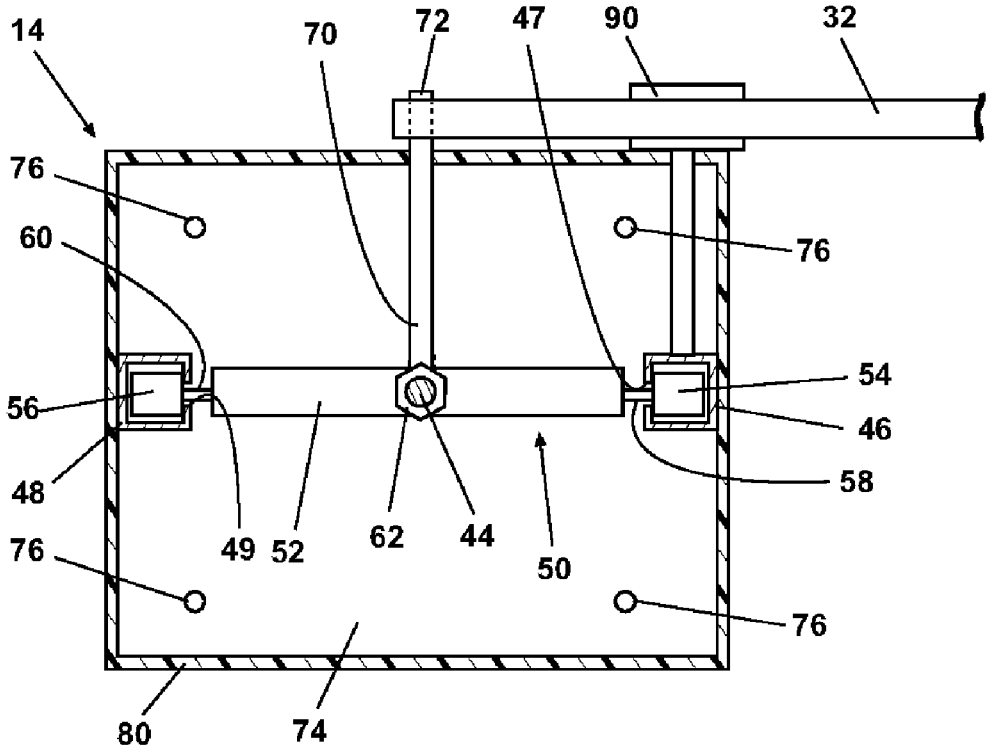
FIG. 5 is a sectional view taken through line 5—5 of FIG. 4.

As illustrated in FIGS. 2 and 3, the power pedestals 14, 16 are box-like enclosures located at two adjoining corners of the tub 20 and having a height somewhat greater than the height of the hot tub 20 and cover 12. The power pedestals 14, 16 are illustrated as structures separate and distinct from the tub 20. However, the power pedestals 14, 16 can alternatively be integrated into the structure of the tub 20. The power pedestals 14, 16 can have any suitable configuration, but preferably comprise a rectilinear framework enclosed by an enclosure 80. Referring to FIGS. 4 and 5, the framework comprises a pair of parallel, spaced-apart vertical members 46, 48 comprising elongated C-channels extending vertically and aligned with facing slotted openings 47, 49. The vertical members 46, 48 can be connected at an upper end thereof by a crossmember 84 rigidly attached thereto, such as by welding, to provide lateral stability to the vertical members 46, 48. The vertical members 46, 48 are rigidly attached, such as by welding, to a rectilinear base plate 74 to extend orthogonally away from the base plate 74. The base plate 74 is provided with a plurality of mounting apertures 76 extending therethrough for attaching the base plate to a wood deck, a concrete slab, or the like, so that the vertical members 46, 48 extend orthogonally away from the deck or slab. The enclosure 80 covers the framework and is attached thereto in a suitable conventional manner, such as by threaded fasteners. To provide additional stability to the power pedestals 14, 16, particularly when the base plates 74 are not attached to a deck or slab, cross members (not shown) can rigidly interconnect the power pedestals 14, 16, such as by welding one or more cross member to each pair of vertical members 46, 48.

Each power pedestal 14, 16 houses an actuator assembly 40 comprising an motor 42 connected to a rotatable threaded shaft 44. The motor 42 can be an electric, hydraulic, or pneumatic motor, powered by a suitable well-known electric, hydraulic, or pneumatic power source (not shown). The motor 42 is shown in FIG. 4 as located at the top of the power pedestals 14, 16, with the threaded shaft 44 extending downwardly therefrom. Alternatively, the motor 42 can be located at the bottom of the power pedestals 14, 16 with the threaded shaft 44 extending upwardly therefrom.

A carriage assembly 50 comprises an elongated carriage bar 52 terminating at each end in a slide block 54, 56 rigidly connected to the carriage bar 52 through a narrow neckpiece 58, 60. The carriage bar 52 can be solid or frame-like, and is preferably fabricated of a metal, such as steel or aluminum, having suitable strength and rigidity for the purposes described herein. The slide blocks 54, 56 are rectilinear, preferably solid bodies adapted for slidable receipt in the vertical members 46, 48. Preferably, the slide blocks 54, 56 comprise a generally frictionless material or a metal piece coated with or encased in a frictionless material to facilitate the translation of the slide blocks 54, 56 in the vertical members 46, 48. The neckpieces 58, 60 are adapted for slidable translation along the slotted openings 47, 49, and connect the slide blocks 54, 56 to the carriage bar 52 to enable the carriage bar 52 to move vertically along the vertical members 46, 48.

The carriage bar 52 is provided at its midpoint with an internally threaded fixture, such as a threaded nut 62, adapted for threaded registry with the threaded shaft 44 so that rotation of the threaded shaft 44 will urge the nut 62 or the threaded fixture along the threaded shaft 44. The nut 62 is fixedly attached to the carriage bar 52, such as by welding, so that the threaded shaft 44 can be threaded through the nut 62. An opening is provided through the center of the carriage bar 52 coaxial with the nut 62 to receive the threaded shaft 44 therethrough. Alternatively, a threaded insert (not shown) can be used, inserted into a suitable aperture in the carriage bar 52 and fixedly attached thereto, such as by welding, an interference or friction fit, or the like.

Figure 6:
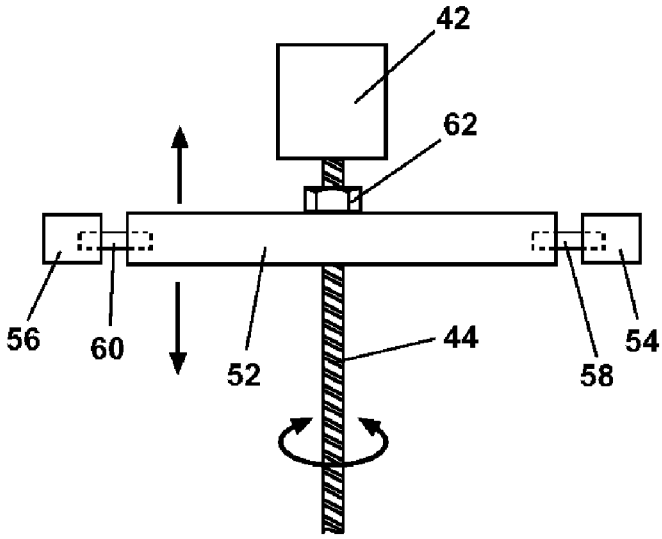
FIG. 6 is an enlarged elevational view of a portion of the hot tub cover lift mechanism shown in FIG. 5.

As illustrated in FIG. 6, operation of the motor 42 will rotate the threaded shaft 44. Rotation of the threaded shaft 44 will urge the translation of the carriage bar 52 along the threaded shaft 44. Rotation of the threaded shaft 44 in a first direction will urge the carriage bar 52 downwardly. Rotation of the threaded shaft 44 in a second direction will urge the carriage bar 52 upwardly.

A shaft 70 extends laterally away from each carriage bar 52 at approximately the mid-point thereof to define a horizontal axis therethrough. The shaft 70 is fixedly attached to the carriage bar 52, and is pivotally connected to the pivot end 36, 38 of the arm segments 30, 32 through a pivot connection 72 to provide for pivotal movement of the lift arm 18 about the horizontal axis of the shaft 70. A fixed pivot roller 90 is attached to the vertical member 46 of each power pedestal 14, 16 to extend outwardly of the power pedestal 14, 16 and to provide support for the arm segments 30, 32. The fixed pivot roller 90 is positioned so that, when the cover 12 is supported upon the hot tub 20, the arm segments 30, 32 will be supported on the pivot rollers 90, as illustrated in FIG. 4.

The arm segments 30, 32 are illustrated in FIGS. 3–5 as connected to the horizontal shafts 70 exteriorly of the power pedestals 14, 16. The pivot rollers 90 are also located exteriorly of the power pedestals 14, 16. With this configuration, the horizontal shafts 70 will move vertically along an interior side of the power pedestals 14, 16. Thus, the enclosure 80 will be provided with a vertical slot to enable the horizontal shaft 70 to travel vertically. Alternatively, the pivot ends 36, 38 of the arm segments 30, 32 can be connected to the carriage bars 52 through the horizontal shaft 70 so that the pivot ends 36, 38 and the horizontal shafts 70 are enclosed within the enclosures 80. In this configuration, the pivot rollers 90 will be located inside the enclosures of the power pedestals 14, 16, and the enclosures 80 will be provided with a suitable opening for receiving the pivot ends 36, 38 and accommodating the pivoting movement of the arm segments 30, 32.

A central control unit (not shown) provides control functions for the operation of the hot tub cover remover 10. For example, the central control unit can provide on/off control functions for the motor 42 in each power pedestal 14, 16, as well as controlling speed, timing, and the like. The central control unit will also synchronize the operation of the actuators 42 to insure that the actuators 42 operate in tandem to coordinate the proper movement of the lift arm 18.

Figure 7:
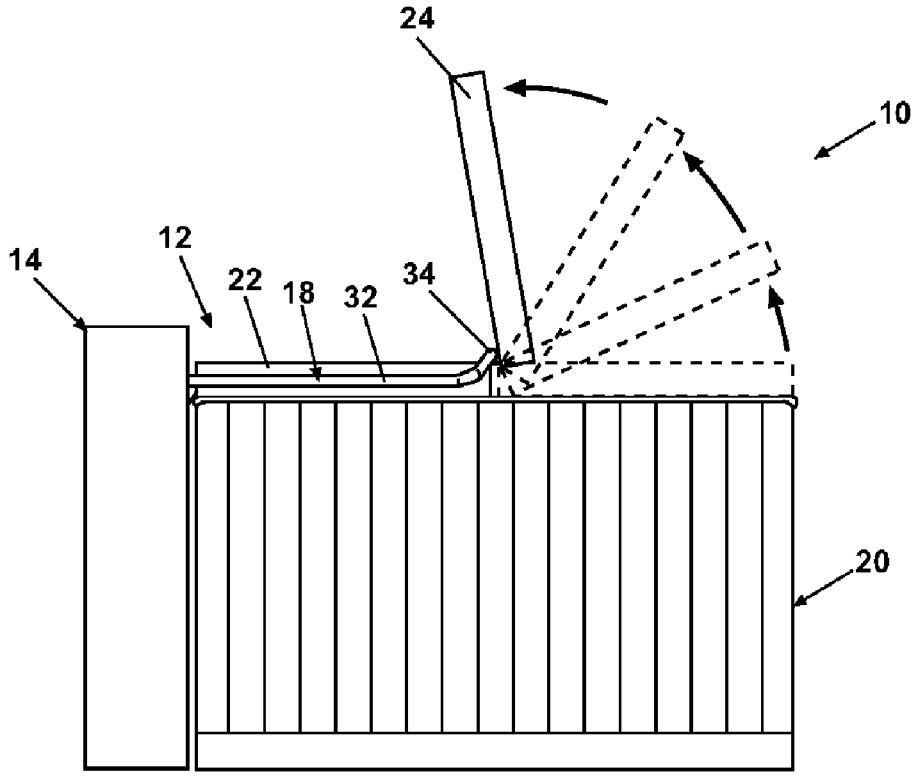
FIG. 7 is a side elevational view of the hot tub and cover lifter mechanism of FIG. 2, showing a first step in the operation of the hot tub cover lifter.
Figure 8:
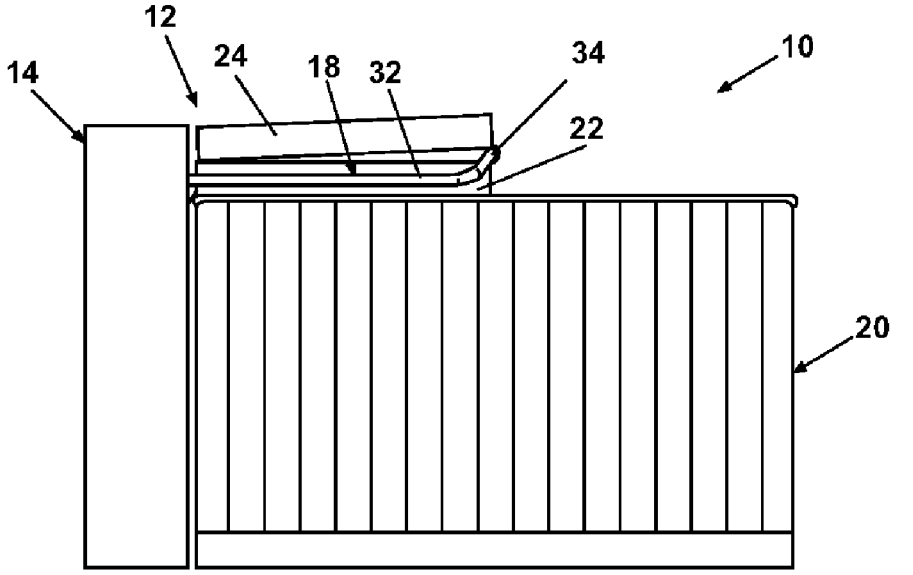
FIG. 8 is a side elevational view of the hot tub and cover lifter mechanism of FIG. 2, showing a second step in the operation of the hot tub cover lifter.
Figure 9:
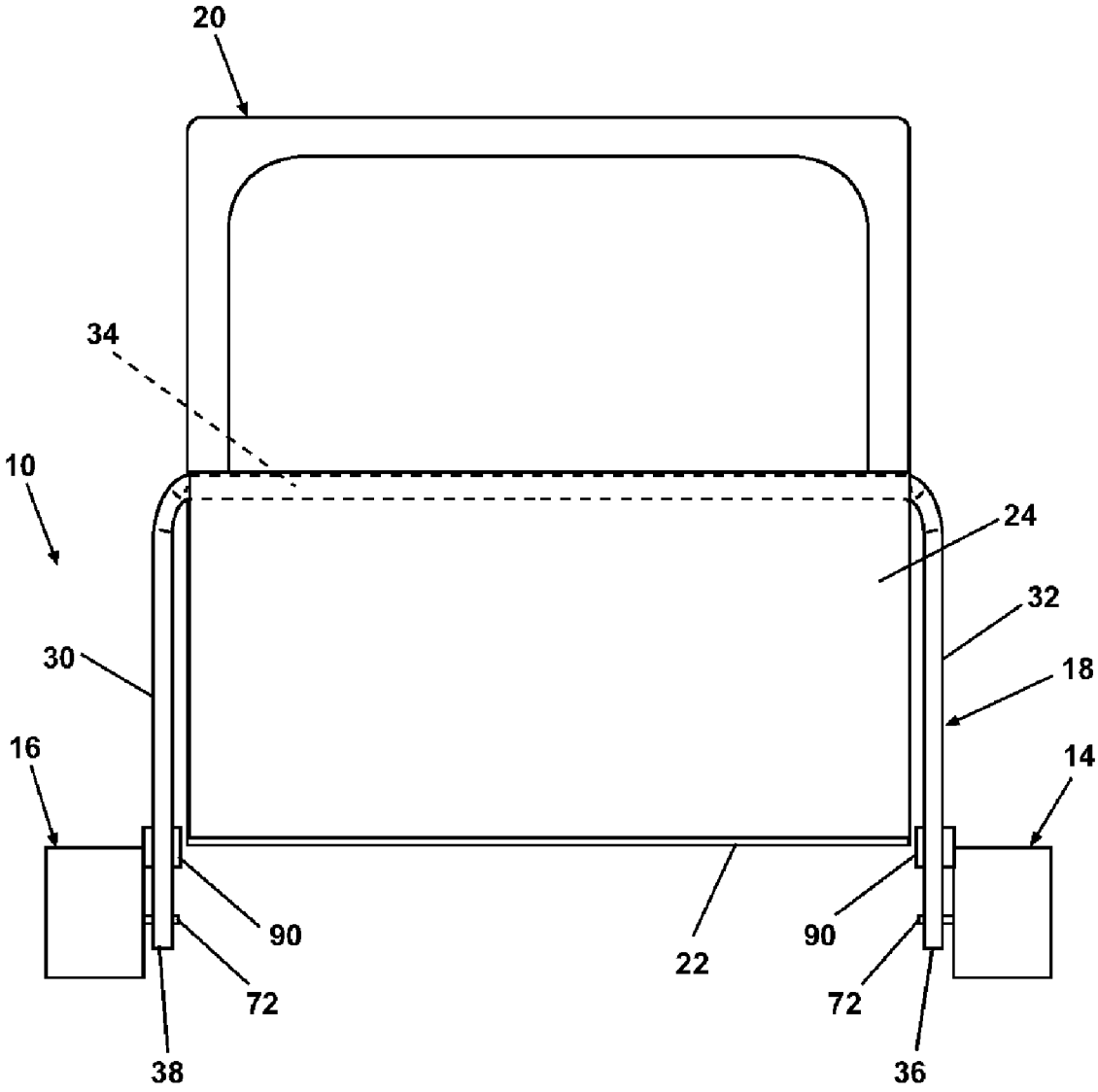
FIG. 9 is a top plan view of the hot tub and cover lift mechanism of FIG. 2 showing the second step in the operation of the hot tub cover lift mechanism.
Figure 10:
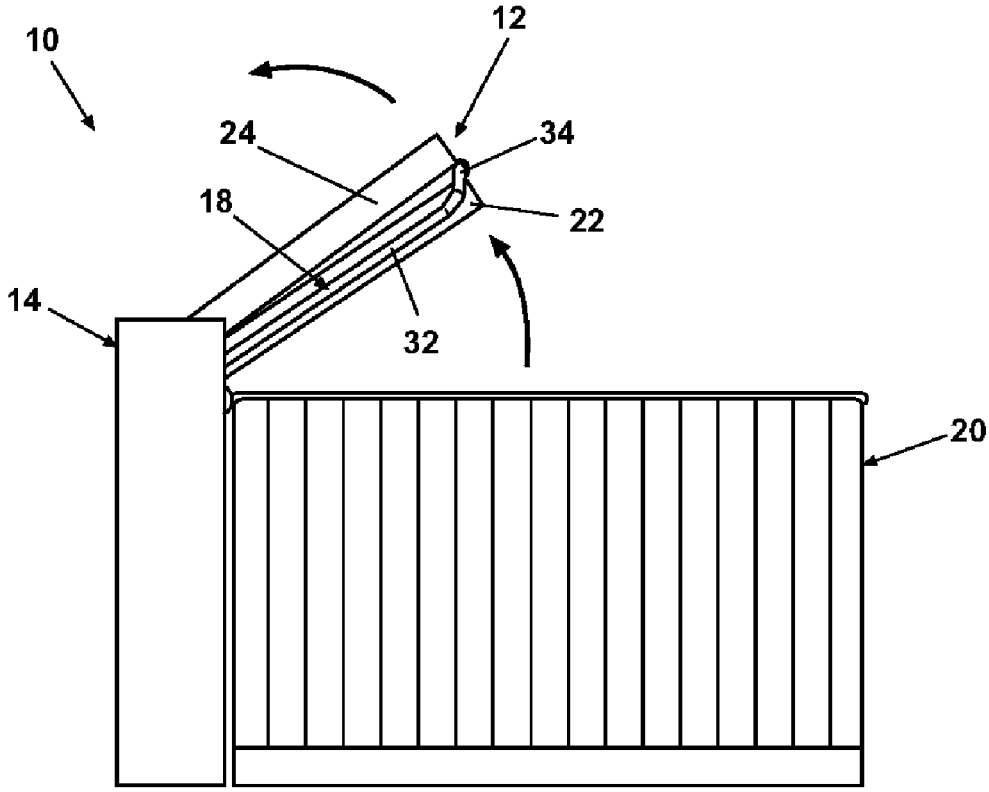
FIG. 10 is a side elevational view of the hot tub and lift mechanism of FIG. 2, showing a third step in the operation of the hot tub cover lift mechanism.
Figure 11:
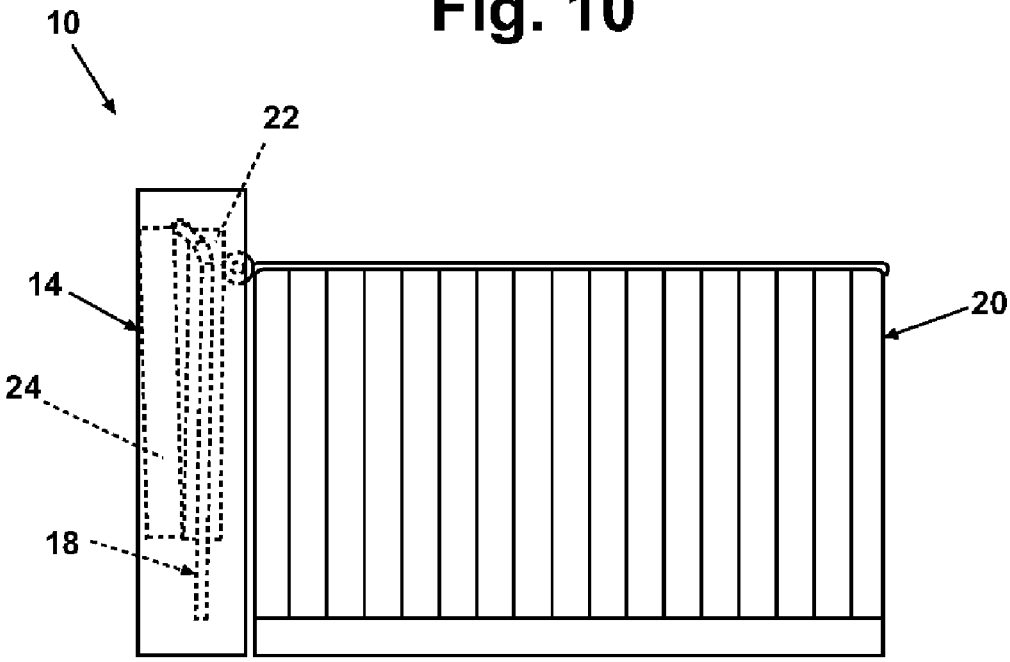
FIG. 11 is a schematic elevational view of the hot tub and lift mechanism of FIG. 2, showing a fourth step in the operation of the hot tub cover lift mechanism with portions shown in phantom for clarity.
Figure 12:
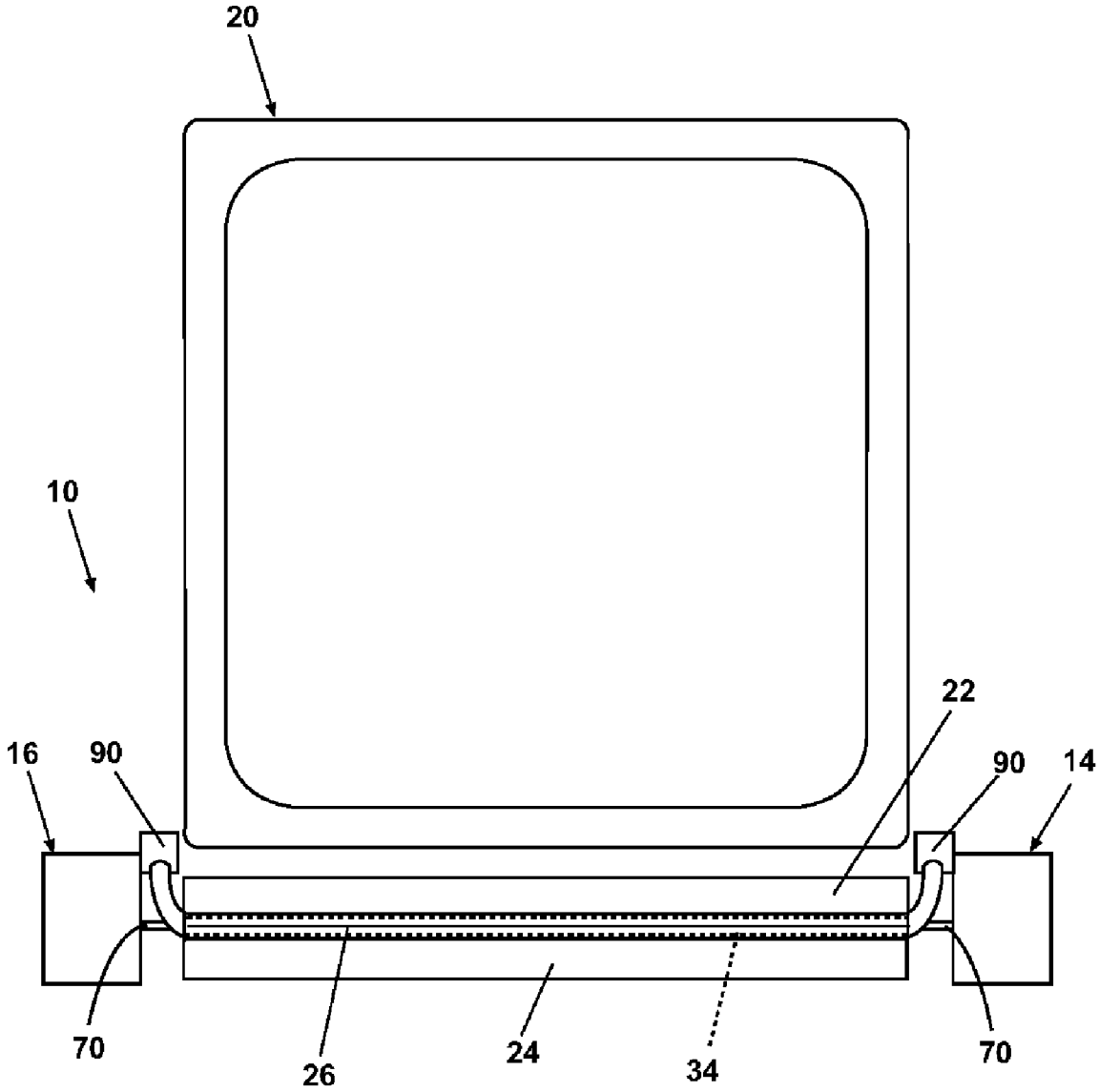
FIG. 12 is a top plan view of the hot tub and cover lift mechanism of FIG. 2, showing the fourth step in the operation of the hot tub cover lift mechanism.
Figure 13:
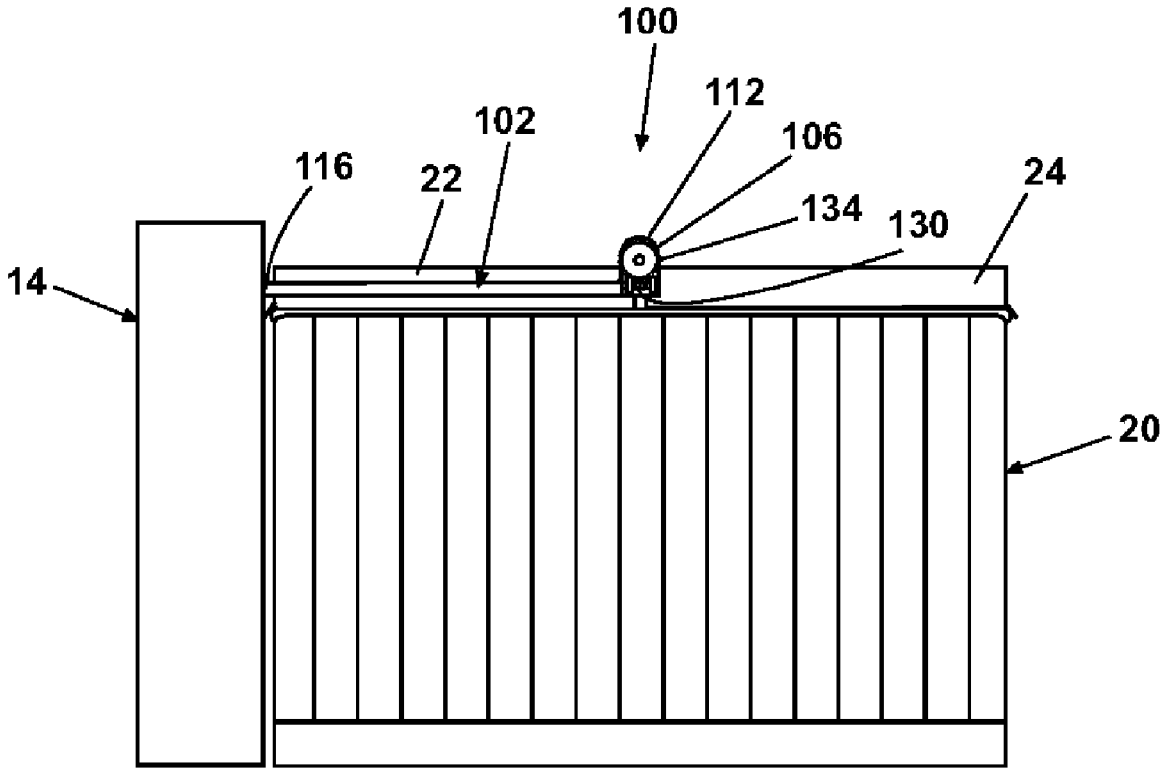
FIG. 13 is a side elevational view of a hot tub having a second embodiment of a hot tub cover lift mechanism according to the invention.

The hot tub cover lifter 10 operates as follows. With the tub 20 fully covered, the user must first manually flip the pad 24 onto the pad 22 (FIGS. 7 and 8). This movement encases the support member 34 along the hinge 26 (FIGS. 8 and 9) in the pads 22, 24. The motors 42 are then activated to turn the threaded shafts 44, and urge the carriage bars 52 in a downward direction. Downward movement of the carriage bars 52 urges the pivot ends 36, 38 of the lift arm 18 in a downward direction. As the pivot ends 36, 38 are moved downwardly, the arm segments 30, 32 pivot about the pivot rollers 90, raising the support member 34 and the cover 12 (FIG. 10). As the carriage bar 52 continues in its downward travel, the cover 12 is lifted to a nearly vertical position with the arm segments 30, 32 inclined somewhat against the pivot rollers 90, thereby enabling the lift arm 18 and the cover 12 to be lowered to a storage position along the side of the tub 20 (FIGS. 11 and 12).

Reversal of the actuators 42 urges the carriage bars 52 into an upward movement, raising the lift arm 18 and the cover 12 from its storage position to a nearly vertical position. The lift arm 18 and cover 12 will tilt toward the tub 20 by gravity, with the arm segments 30, 32 rotating downwardly about the pivot rollers 90. As the lift arm 18 continues to rise, the arm segments 30, 32 will continue to pivot about the pivot rollers 90, lowering the cover 12 until it again covers half the tub 20. The pad 24 is then manually rotated off the pad 22 to completely cover the tub 20.

A second embodiment of a hot tub cover remover according to the invention is illustrated in FIGS. 13–22 to which reference is now made. The hot tub cover remover 100 is illustrated as comprising a pair of lift arms 102, 103, a pair of pivot arms 104, 105, and an interconnecting pivot shaft 106. The lift arms 102, 103 comprise elongated, hollow members, preferably fabricated of thin-walled steel or aluminum tubing, having a generally rectilinear cross-section defining a rectilinear gear channel 114 extending longitudinally therethrough. The distal end of the lift arms 102, 103 terminates in a gear bracket 112. The proximal, pivot end 116 of the lift arm 102 is adapted for fixedly attaching an actuator 108 thereto. The lift arms 102, 103 extend along either side of the pad 22 and are pivotally connected at a proximal, pivot end 116, 118, respectively, to the carriage bar 52 through the shaft 70 to rest on the pivot rollers 90, as previously discussed with respect to the first embodiment.

Figure 14:
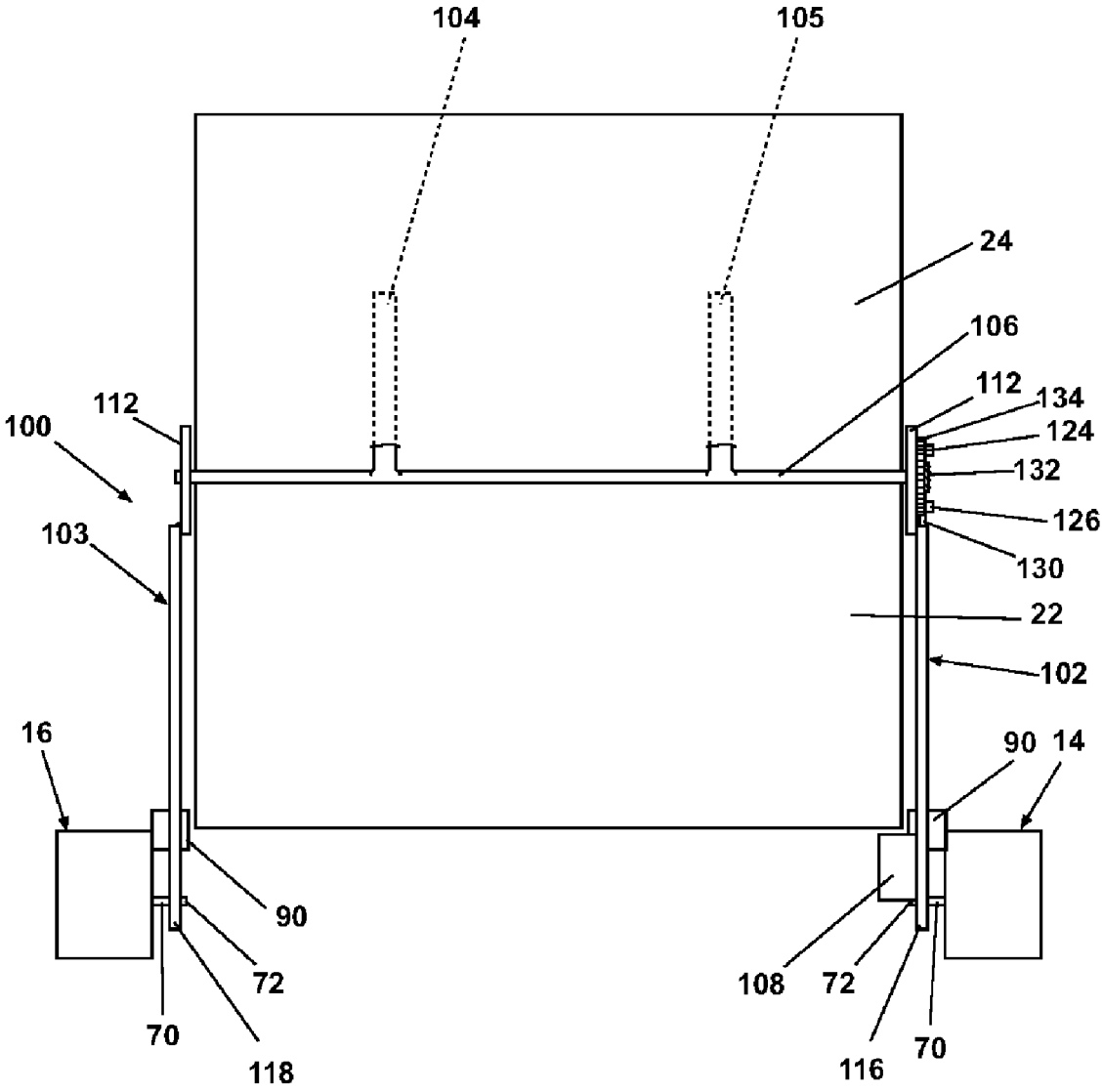
FIG. 14 is a top plan view of the hot tub cover and cover lift mechanism of FIG. 13.
Figure 15:
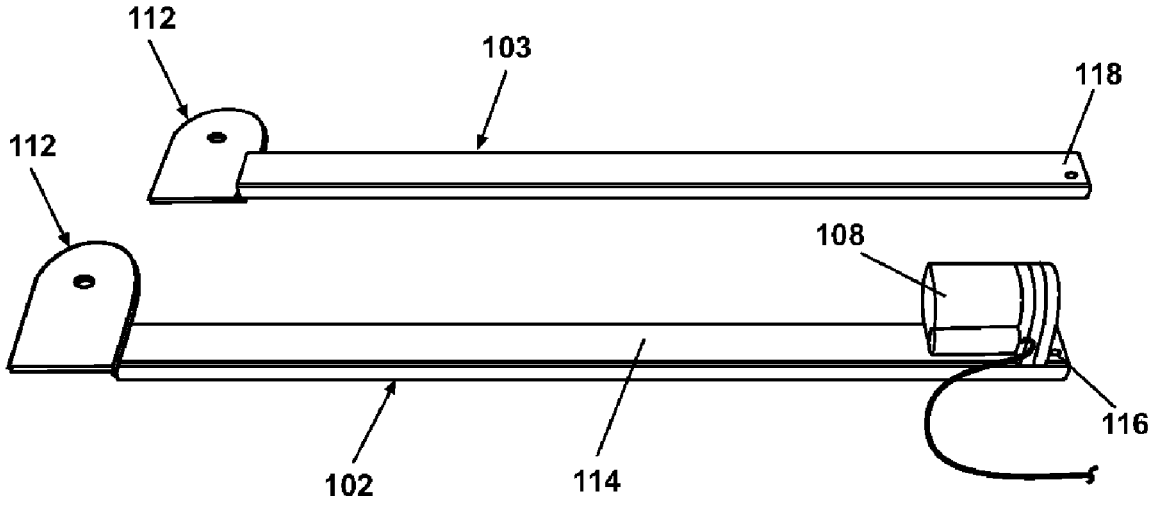
FIG. 15 is an enlarged perspective view of lift arms illustrated in FIG. 14, illustrating an actuator for lifting a hot tub cover pad.

The pivot arms 104, 105 are elongated, somewhat plate-like members extending in parallel, spaced relationship along the top of the pad 24. Preferably, the pivot arms 104, 105 are located at about the third lines of the pad 24, and are attached to the pad 24 by inserting the pivot arms 104, 105 into suitable pockets formed in the pad 24, as illustrated in FIG. 14. Alternatively, the pivot arms 104, 105 can be attached to the pad 24 by straps, or other suitable fasteners. The pivot arms 104, 105 can have a suitable length selected for the purposes described herein. A single arm can be used in place of the two arms illustrated herein, extending along the midline of the pad 24 and secured thereto in a similar manner.

Figure 16:
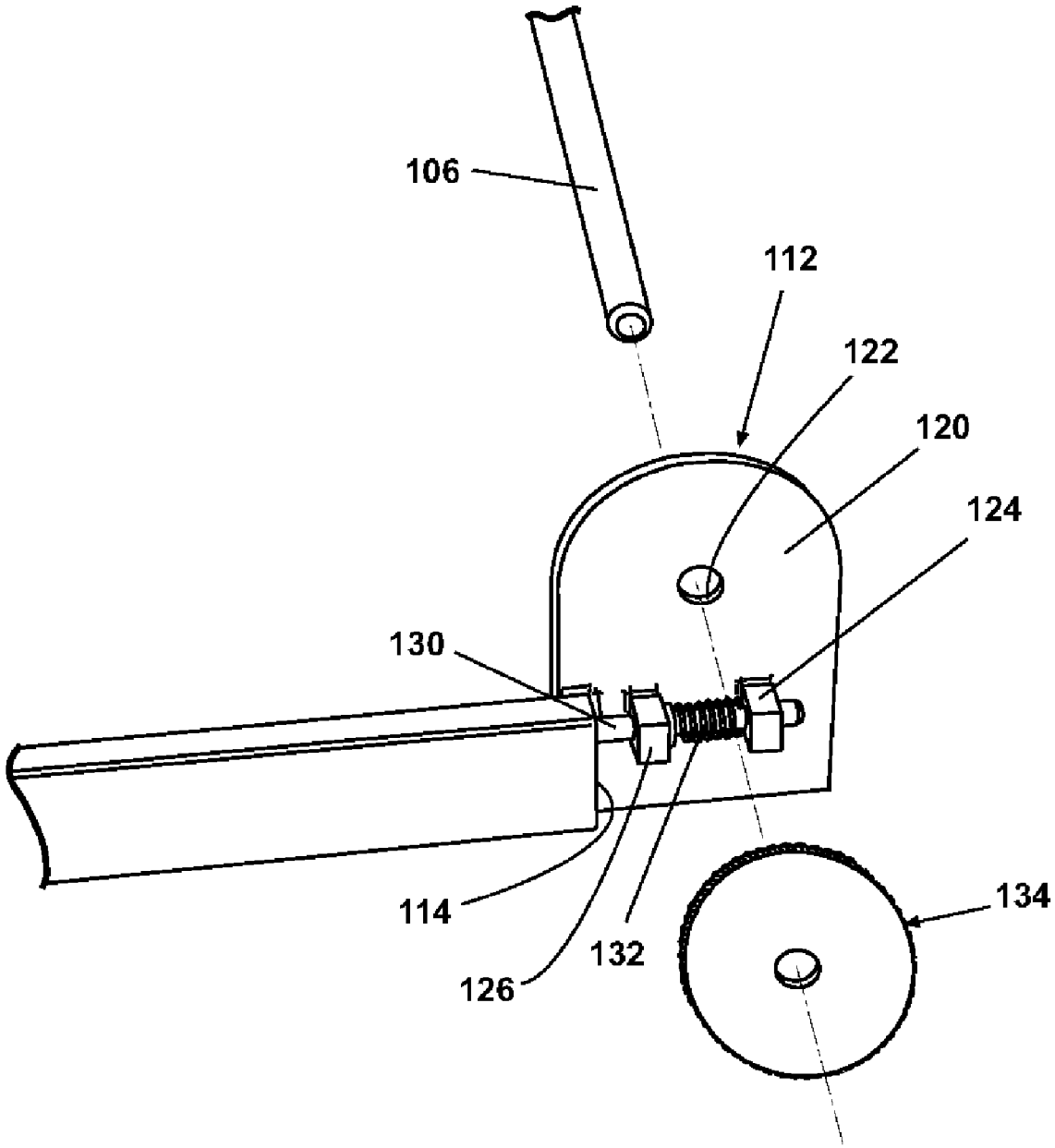
FIG. 16 is an enlarged perspective view of a first end portion of one of the lift arms illustrated in FIG. 15.

Referring specifically to FIG. 16, the gear bracket 112 comprises a somewhat D-shaped bracket plate 120 having a curved edge and rigidly attached, such as by welding, along a linear edge to the distal end of each lift arm 102, 103 to extend transversely away from the lift arm 102, 103. An aperture 122 extends through the bracket plate 120 and is centered along the curved edge. Adjacent to the linear edge and collinear with the drive channel 114 are a pair of bearing blocks 124, 126 rigidly attached, such as by welding, to the bracket plate 120 and having apertures extending therethrough collinear with the drive channel 114.

Figure 17:
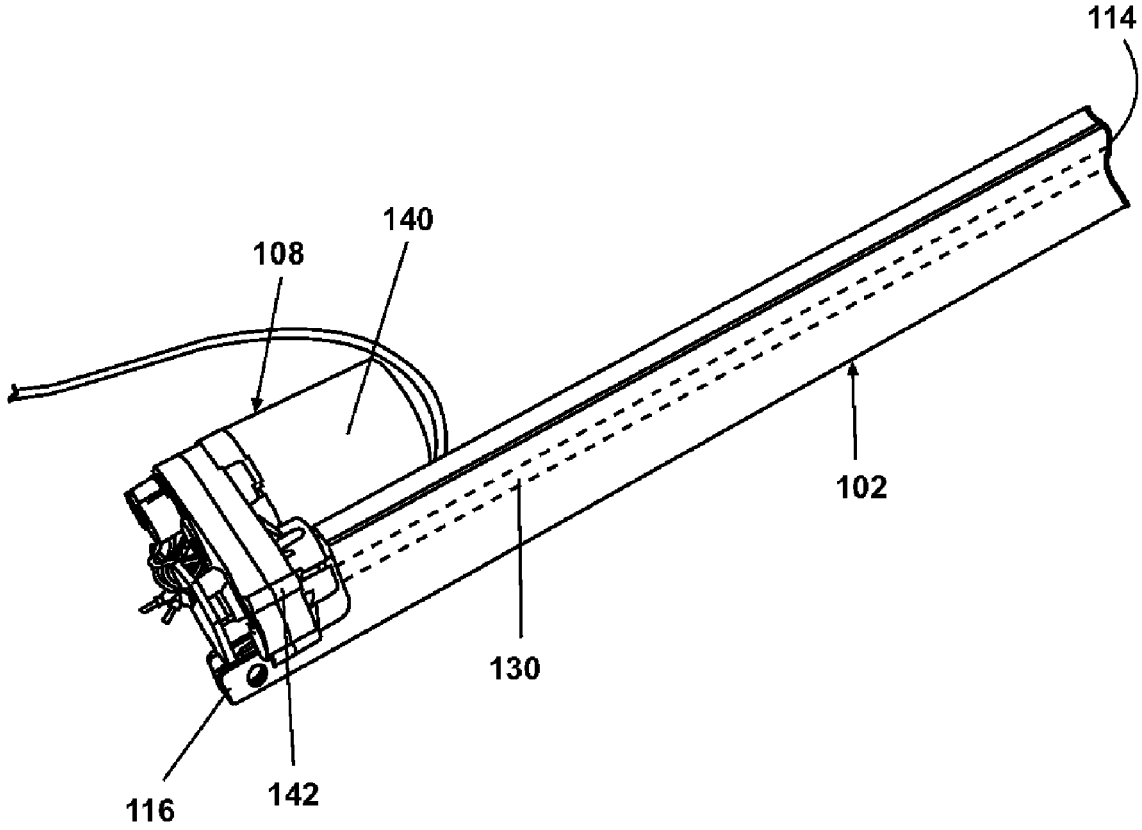
FIG. 17 is an enlarged perspective view of a second and portion of one of the lift arms illustrated in FIG. 15.

Referring to FIG. 17, which provides an enlarged illustration of the pivot end 116 of the lift arm 102, the actuator 108 comprises an actuator motor 140 operably connected to a transmission 142. The actuator motor 140 can comprise an electrical, hydraulic, or pneumatic motor. Referring also to FIG. 16, which provides an enlarged illustration of the gear bracket 112 of the lift arm 102, a drive shaft 130 extends from the transmission 142 through the drive channel 114 and the bearing blocks 124, 126 for rotation within the drive channel 114 and the bearing blocks 124, 126. A portion of the drive shaft 130 intermediate the bearing blocks 124, 126 comprises a worm gear 132.

The pivot shaft 106 is a cylindrical rod-like member adapted for rotational support within the apertures 122 of the bracket plates 120. An end of the pivot shaft 106 associated with the lift arm 102 is fixedly attached to a drive gear 134 adapted for operable engagement with the worm gear 132, so that rotation of the worm gear 132 will rotate the drive gear 134. The pivot shaft 106 extends between the lift arms 102, 103 to cross over the hot tub cover 12 along the hinge 26 between the pads 22, 24. The pivot arms 104, 105 are rigidly connected to the pivot shaft 106 at approximately the third points thereof to extend radially away from the shaft 106. Thus, as the pivot shaft 106 rotates, the pivot arms 104, 105 will undergo angular movement about an axis corresponding with the longitudinal axis of the pivot shaft 106.

The hot tub cover remover of this embodiment is illustrated with a single actuator 108 attached to a single lift arm 102. However, each lift arm 102, 103 can be provided with an actuator 108 for lifting particularly large or heavy covers.

Figure 18:
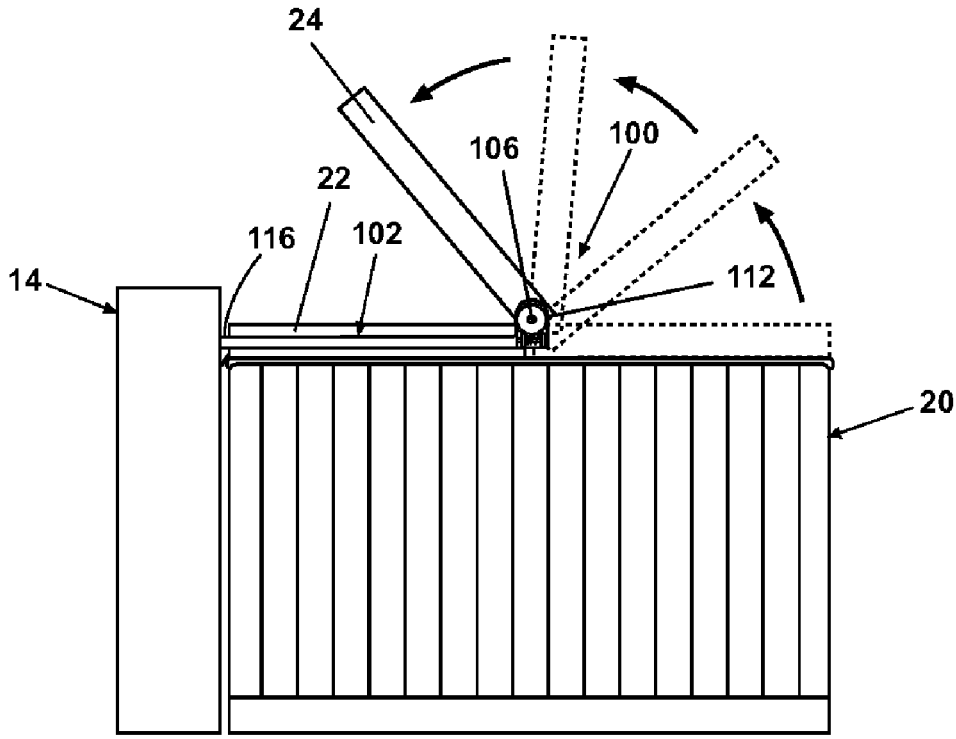
FIG. 18 is a side elevational view of the hot tub and cover lift mechanism of FIG. 13, showing a first step in the operation of the hot tub cover lift mechanism.
Figure 19:
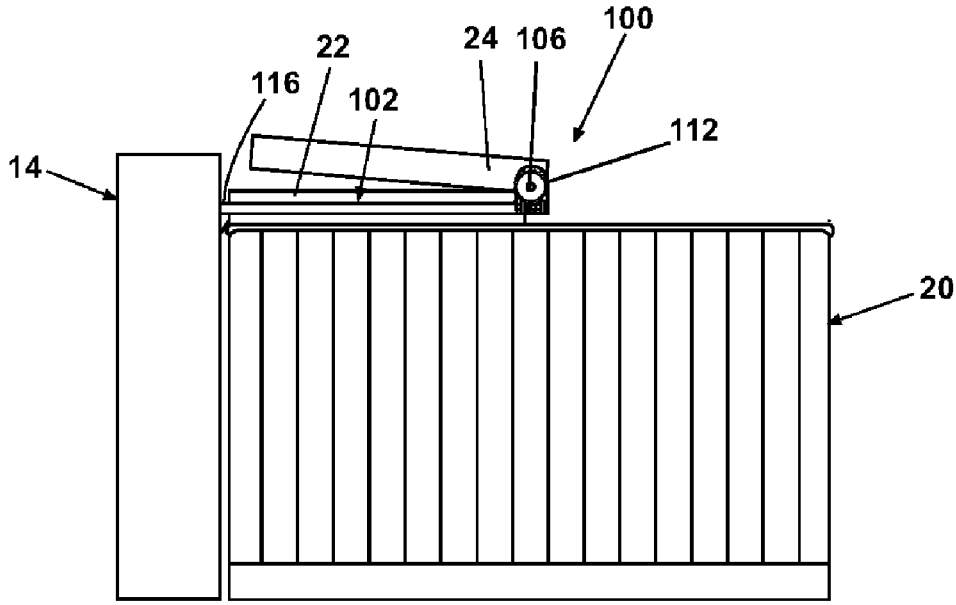
FIG. 19 is a side elevational view of the hot tub and cover lift mechanism of FIG. 13 showing a second step in the operation of the hot tub cover lift mechanism.
Figure 20:
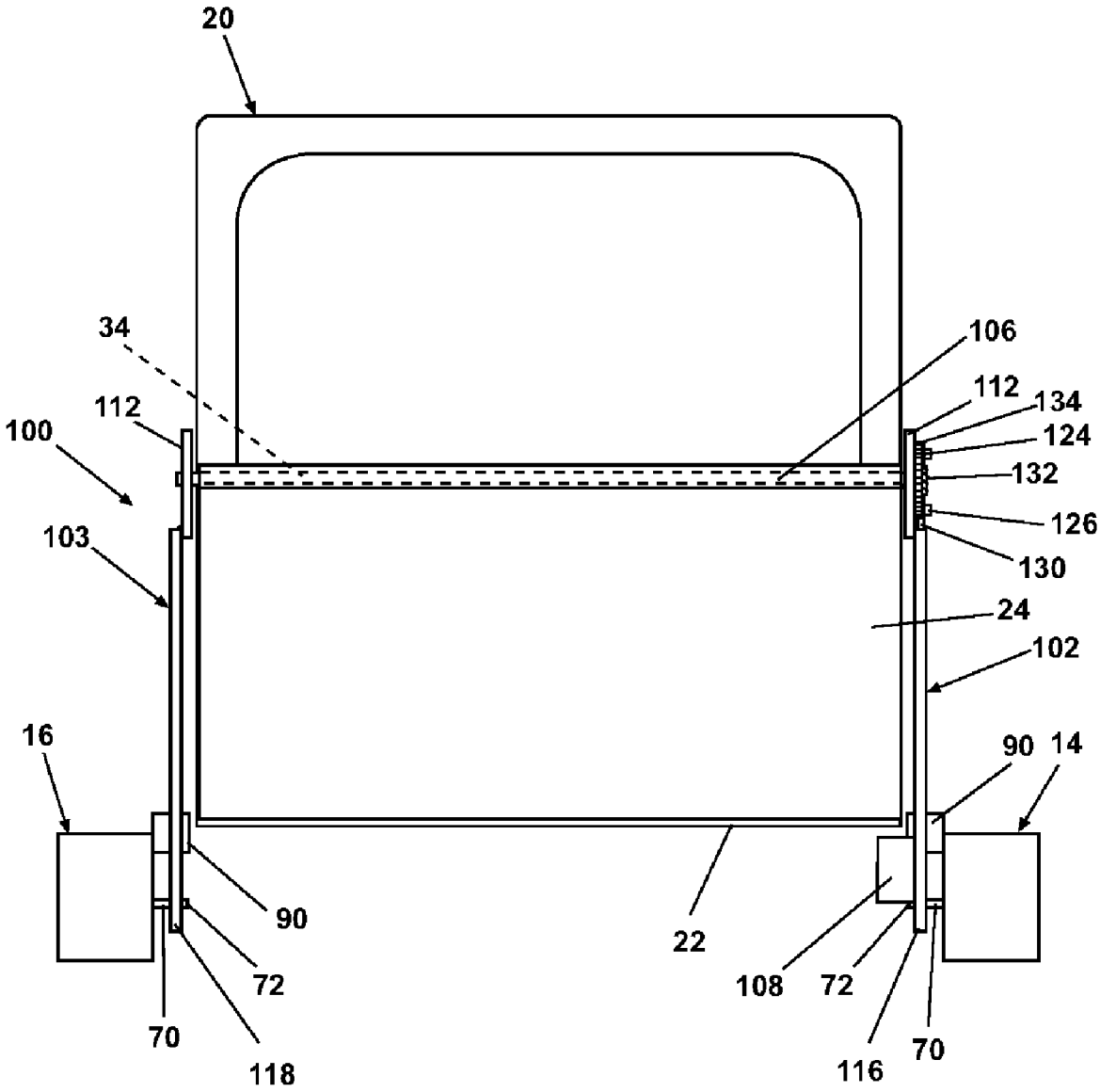
FIG. 20 is a top plan view of the hot tube and cover lift mechanism of FIG. 13, showing the second step in the operation of the hot tub cover lift mechanism.

When the actuator 108 is activated, the drive shaft 130 and the worm gear 132 will rotate, rotating the drive gear 134 and the pivot shaft 106. This movement will raise the pivot arms 104, 105 and the pad 24, rotating the pad 24 about the hinge 26 and away from the tub 20 (FIG. 18). When the actuator 108 has reached the end of its range of travel, the pad 24 will be positioned on top of the pad 22 (FIGS. 19 and 20).

Figure 21:
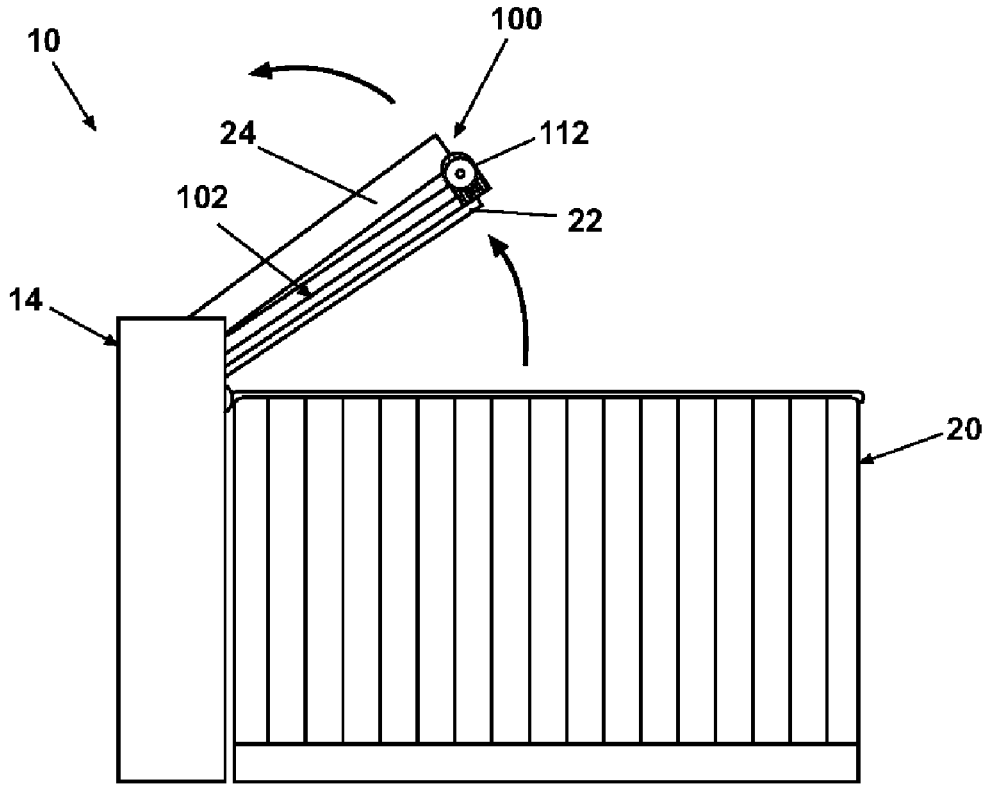
FIG. 21 is a side elevational view of the hot tub and cover lift mechanism of FIG. 13, showing a third step in the operation of the hot tub cover lift mechanism.
Figure 22:
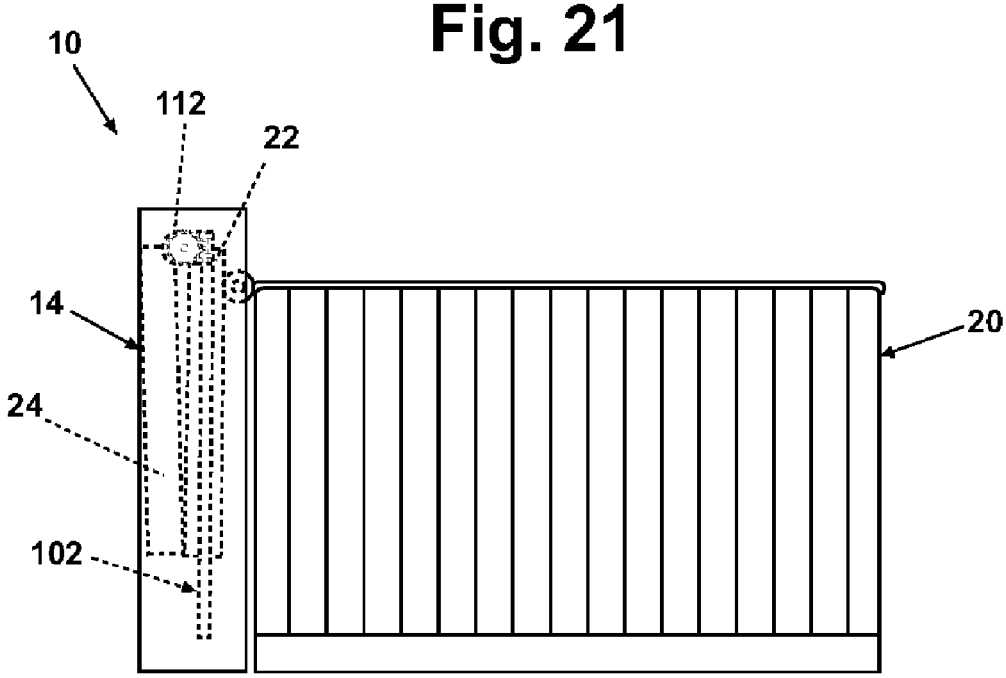
FIG. 22 is a side elevational view of the hot tub and cover lift mechanism of FIG. 13, showing a fourth step in the operation of the hot tub cover lift mechanism with portions shown in phantom for clarity.

The actuator assembly 40 will then be activated to begin pivoting the lift arms 102, 103 as previously described with respect to the first embodiment. (FIG. 21). As the lift arms 102, 103 continue to pivot about the pivot rollers 90, the cover 12 is lifted to a nearly vertical position and then lowered to its storage location along the side of the tub 20 (FIG. 22).

Reversal of the actuator assembly 40 will cause the lift arms 102, 103 and the cover 12 to rise from the storage position, pivot about the pivot rollers 90, and return to a horizontal position with the pad 22 resting on top of the tub 20. The pivot arms 104, 105 and the pad 24 are then rotated away from the pad 22 through a reverse activation of the actuator 108 until the pad 24 rests on top of the tub 20 and the cover 12 completely covers the tub 20.

In another embodiment of the semi-automatic hot tub cover lift mechanism, the lift arms 102, 103 can be employed without the pivot arms 104, 105 for lifting of the cover 12 after the pad 24 has been manually placed on the pad 22 as with the first embodiment described herein. Rather than the U-shaped lift arm 18 described with respect to the first embodiment, the lift arms 102, 103 will be connected by a shaft similar to the pivot shaft 106, but without the pivot arms 104, 105, the actuator 108, the drive shaft 130, or the drive gear 134. In this embodiment, the shaft can be rigidly attached to the gear brackets 112 on the lift arms 102, 103 to form a U-shaped lift arm assembly.

The hot tub cover remover described herein will eliminate the difficulty with removing and storing heavy hot tub covers. It improves the safety of hot tubs by facilitating the use of hot tub covers while enabling the covers to be easily moved and stored. The hot tub cover remover will also facilitate the use of hot tubs by those who are elderly or physically limited in their ability to move and store hot tub covers. It will also increase the likelihood that the cover will be replaced after use, making hot tubs safer and improving their aesthetics and overall function.

While the invention has been specifically described in connection with certain embodiments thereof, it is to be understood that this is by way of illustration and not of limitation. Reasonable variation and modification are possible within the scope of the forgoing description and drawings without departing from the spirit of the invention, which is described in the appended claims.

What is claimed is:

1. A lifting mechanism for removing and storing a hot tub cover, comprising:

at least one power pedestal having a rotational actuator, a threaded shaft rotated by the actuator, a carriage bar having a threaded aperture adapted for threadable cooperation with the threaded shaft, and a fixed roller adapted for rotation about a horizontal axis;

at least one lift arm attached to the hot tub cover and adapted for lifting the hot tub cover from the hot tub;

wherein a free end of the lift arm is pivotably attached to the carriage bar and rests upon the fixed roller, and the carriage bar is adapted to translate vertically with rotation of the threaded shaft by the actuator, so that the vertical translation of the carriage bar will urge the pivotal movement of the lift arm about the fixed roller to selectively raise and lower the hot tub cover.

2. The lifting mechanism of claim 1, wherein the hot tub cover comprises a first cover portion connected by a hinge to a second cover portion, and further comprising a pivot arm pivotably connected to the at least one lift arm for selectively pivoting the second cover portion relative to the first cover portion.

3. The lifting mechanism of claim 2, wherein the lifting mechanism further comprises an actuator, a drive shaft, and a gear assembly interconnecting the drive shaft and the pivot connection, and wherein the actuator rotates the drive shaft, the drive shaft turns the gear assembly, and the gear assembly rotates the pivot arm to pivot the second cover portion relative to the first cover portion.

* * * * *